US007998889B2

(12) United States Patent
Stralin et al.

(10) Patent No.: US 7,998,889 B2
(45) Date of Patent: Aug. 16, 2011

(54) HYDROENTANGLED INTEGRATED COMPOSITE NONWOVEN MATERIAL

(75) Inventors: Anders Stralin, Torslanda (SE); Camilla Bemm, Gothenburg (SE); Mikael Strandqvist, Lindome (SE)

(73) Assignee: SCA Hygiene Products AB, Gothenburg (SE)

( * ) Notice: Subject to any disclaimer, the term of this patent is extended or adjusted under 35 U.S.C. 154(b) by 42 days.

(21) Appl. No.: 11/926,897

(22) Filed: Oct. 29, 2007

(65) Prior Publication Data

US 2008/0050996 A1 Feb. 28, 2008

Related U.S. Application Data

(63) Continuation of application No. PCT/SE2005/000626, filed on Apr. 29, 2005.

(51) Int. Cl.
*D04H 1/46* (2006.01)
*D04H 5/02* (2006.01)
*D04H 13/00* (2006.01)

(52) U.S. Cl. ..... 442/408; 442/402; 442/403; 442/405; 442/407; 28/103; 28/104; 28/107; 28/108

(58) Field of Classification Search ..... 442/384, 442/402, 403, 405, 407, 408; 28/103, 104, 28/105, 107, 108
See application file for complete search history.

(56) References Cited

U.S. PATENT DOCUMENTS

| | | | | |
|---|---|---|---|---|
| 3,494,821 | A * | 2/1970 | Evans | 442/352 |
| 4,190,695 | A * | 2/1980 | Niederhauser | 442/2 |
| 4,775,579 | A | 10/1988 | Hagy et al. | |
| 5,952,251 | A | 9/1999 | Jackson et al. | |
| 6,163,943 | A * | 12/2000 | Johansson et al. | 28/104 |
| 6,314,627 | B1 | 11/2001 | Ngai | |
| 6,592,713 | B2 | 7/2003 | Ahoniemi | |
| 6,903,034 | B1 * | 6/2005 | Putnam et al. | 442/408 |
| 7,432,219 | B2 * | 10/2008 | Strandqvist et al. | 442/408 |
| 2005/0112980 | A1 | 5/2005 | Strandqvist | |

FOREIGN PATENT DOCUMENTS

| | | |
|---|---|---|
| EP | 0 308 320 A2 | 3/1989 |
| EP | 0 308 320 B1 | 3/1989 |
| EP | 0 333 211 | 9/1989 |
| EP | 0 333 212 | 9/1989 |
| EP | 0 333 228 | 9/1989 |
| EP | 0 423619 | 4/2004 |
| WO | WO 02/38846 | 5/2002 |
| WO | WO 2005/042819 | 5/2005 |
| WO | WO 2005/059218 | 6/2005 |

* cited by examiner

*Primary Examiner* — Angela Ortiz
*Assistant Examiner* — Jennifer Steele
(74) *Attorney, Agent, or Firm* — Young & Thompson

(57) ABSTRACT

An hydroentangled integrated composite nonwoven material, includes a mixture of randomized continuous filaments, and synthetic staple fibers, where there are no thermal bonding points between the continuous filaments. The nonwoven material exhibits a cumulative pore volume, measured by PVD in n-hexadecane, in the pore radius range 5-150 μm, where at least 70% of the cumulative pore volume is in the pores with a pore radius above 45 μm. The nonwoven material also exhibits a cumulative pore volume, which when the synthetic staple fibers are chosen from the group of polyethylene, polypropylene, polyester, polyamide, and polylactide staple fibers is at least 9 $mm^3$/mg, and when the synthetic staple fibers are lyocell staple fibers is at least 6 $mm^3$/mg.

13 Claims, 3 Drawing Sheets

HYDROENTANGLED INTEGRATED COMPOSITE NONWOVEN MATERIAL

CROSS-REFERENCE TO RELATED APPLICATION

This is the 35 U.S.C. 371 National Stage of international application FCT/SE2005/000626, filed on 29 Apr. 2005, which designated the United States of America.

FIELD OF THE INVENTION

The present invention refers to a hydroentangled integrated composite nonwoven material, comprising a mixture of continuous filaments and synthetic staple fibres where the filaments are unbonded.

BACKGROUND OF THE INVENTION

Nonwoven materials are often used as polishing wipes, e.g. to add wax and polish it to a good shine in the car and similar industries.

A good polishing material should be soft, pliable, non-scratching, able to absorb and release wax, be well integrated in order to avoid release of debris, have an even distribution of the fibres and may exhibit antistatic properties.

Waxes have properties that in some respects places them between solid and liquids. This makes them difficult to handle.

Textile cloths have been used, often in the form of rags. These normally have high density and low bulk, which render them less fit for the planned use. They will readily absorb wax, but the release of the wax from the cloth is incomplete; the cloth will quickly get filled with wax and soggy.

On the market there are polishing materials made entirely from synthetic staple fibres. These are manufactured from 35-60 mm long fibres that are carded into a web which is then hydroentangled before drying. Many of the materials are apertured to enhance the release of wax.

There is also a thermobonded spun bond material intended for polishing available on the market. This is rather flat in its structure. The melted and then resolidified fibres in the bonding points can be hard and might scratch a surface to be polished.

US patent application publication 2002/0157766A1 teaches a method to make a 100% synthetic hydroentangled material by laying a web of carded fibres adjacent to an unbonded web of spunlaid continuous filaments and joining them by hydroentanglement. Alternatively, two layers can be laid under and above the web of spunlaid filaments. The combined webs are then compacted by pressing and hydroentangled. No specific mixing of fibres and filaments is mentioned, the fibres are bonded into the filament part of the combine, which gives a type of laminate.

It is stated that the material has good mechanical properties equivalent to thermobonded spunbond webs, and appearance, handle and pliancy of conventional textiles.

International Publication WO 03/001962 teaches a cleaning sheet made by joining at least three layers by hydroentanglement. Two of the layers are carded webs of synthetic fibres while the third layer, the reinforcing layer, can be a thermobonded spunbond web. The stated advantage is that no scrim or netting is needed. Also, this method suffers from the disadvantages of using carded fibres.

Applicant's own International Publication WO 2005/042819 teaches a method to make a nonwoven hydroentangled material where a mixture of synthetic shortcut staple fibres and at least 20% natural fibres are wetlaid down on an unbonded web of spunlaid continuous filaments and then hydroentangled.

The unbonded filaments enable the staple and natural fibres to enmesh very thoroughly with the filaments. The natural fibres are integral to form an effective bonding of the material and also to render it good water absorption properties. The material have small pores, suitable for absorption of water. Natural fibres, such as wood pulp, are abrasive and may scratch and damage the finish of a surface to be polished.

Applicant's own International Publication WO 2006/001739 teaches a method to make a nonwoven hydroentangled material where a mixture of synthetic splittable shortcut staple fibres and optional nonsplittable staple fibres are wetlaid down on an unbonded web of spunlaid continuous filaments and then hydroentangled. The intensive water jets of the hydroentangling will split the splittable fibres into many fine fibrils. The unbonded filaments enable the fibrils and fibres to enmesh very thoroughly with the filaments. The fine fibrils are integral to form an effective bonding of the material and also to render its good absorption properties for low-viscosity liquids. The material have small pores, suitable for absorption of water and organic solvents. The many fibril ends sticking out from the surface gives the material a very textile-like appearance.

Notwithstanding the fact that there exist many different nonwoven materials for various wiping purposes, there still is a need for nonwoven materials that are suitable for polishing purposes, i.e. with large pores that are able to store wax and then release it to the surface to be polished. A material with structural apertures all through the material would let the wax escape to the backside when polishing pressure is added.

The materials known are often too dense to have a proper pore size distribution to effectively handle wax absorption and release. A too compact material does not release the wax the way it should.

Such a material should also be possible to be produced efficiently and economically and have enough textile likeness. It should not be abrasive, which could damage the surface to be polished.

OBJECTS OF THE INVENTION

It is an object of the present invention to provide an improved hydroentangled integrated composite nonwoven material, comprising a mixture of randomized continuous filaments, and synthetic staple fibres, where there are no thermal bonding points between the continuous filaments, which is suitable for polishing purposes, e.g. when wax is used.

It is also an object of the present invention to provide an improved hydroentangled integrated composite nonwoven material, comprising a mixture of randomized continuous filaments, and synthetic staple fibres, where there are no thermal bonding points between the continuous filaments, which has a pore size distribution which is suitable for polishing wax absorption and release.

SUMMARY OF THE INVENTION

This has according to the invention been obtained by providing such a hydroentangled nonwoven material where the nonwoven material exhibits a cumulative pore volume, measured by PVD in n-hexadecane, in the pore radius range 5-150 μm, where at least 70% of the cumulative pore volume is in the pores with a pore radius above 45 μm.

The large pores, above 45 μm up to 150 μm, in the inventive material can easily both hold and release wax compositions.

A preferred material according to the invention is a material where the nonwoven material exhibits a cumulative pore volume, measured by PVD in n-hexadecane, in the pore radius range 5-150 μm, which when the synthetic staple fibres are chosen from the group of polyethylene, polypropylene, polyester, polyamide, and polylactide staple fibres is at least 9 $mm^3$/mg.

A large effective pore volume that can hold (and release) a large amount of wax is essential to construct a material that is very useful as a wax polishing material.

Another preferred material according to the invention is a material where the nonwoven material exhibits a cumulative pore volume, measured by PVD in n-hexadecane, in the pore radius range 5-150 μm, which when the synthetic staple fibres are lyocell staple fibres is at least 6 $mm^3$/mg.

Even with the cellulosic lyocell fibres, which can absorb some water, it is essential to achieve a large pore volume. The lyocell gets more pliable in the wet state than the plastic staple fibres, and will thus be more compacted. Still, a fairly high pore volume can be achieved.

A preferred material according to the invention is one where the continuous filaments are spunlaid filaments.

A preferred material according to the invention is one where the continuous filaments are chosen from the group of polypropylene, polyester, and polylactide filaments.

A preferred material according to the invention is one where the synthetic staple fibres are chosen from the group of polyethylene, polypropylene, polyester, polyamide, polylactide, and lyocell staple fibres.

A preferred material according to the invention is one where the continuous filaments have a titer of 1.5-4 dtex.

Fairly large diameters (~dtex) are preferred to assist in achieving a bulky and porous material.

A preferred material according to the invention is a material where the synthetic staple fibres are chosen from the group of polyethylene, polypropylene, polyester, polyamide, and polylactide staple fibres and have a titer of 1-4 dtex.

A preferred material according to the invention is a material where the synthetic staple fibres are lyocell staple fibres and have a titer of 2-4 dtex.

A preferred material according to the invention is a material where substantially all (more than 95 w-%) the synthetic staple fibres are above 1.5 dtex.

A preferred material according to the invention is a material where the mixture of filaments and fibres comprises 20-80%, preferably 30-60%, continuous filaments, and 20-80%, preferably 40-70%, synthetic staple fibres, all percentages calculated by weight of the total nonwoven material.

A preferred material according to the invention is a material where the continuous filaments web part of the composite has a basis weight between 15 and 50 g/$m^2$.

Most of the total strength of the hydroentangled nonwoven material comes from the filament part of the material. The differing, and sometimes competing, needs and demands between strength and other favourable properties can be balanced by adjusting the relative amount of filaments and staple fibres.

A preferred material according to the invention is a material that does not comprise any natural fibres.

Natural fibres are much too pliable in the wet state to be used for the inventive material. Mostly, they are flat and can have been fibrillated before the wetlaying operation, and will result in much smaller pore sizes. Thus, natural fibres don't have neither form nor structure to assist in building a high-volume material.

Furthermore, during the drying process step, natural fibres will develop hydrogen bonds that will pull the fibres together and lock the nonwoven structure into a stiff and harsh material.

Further advantageous materials can of course be realized by combining ideas from the dependent claims.

BRIEF DESCRIPTION OF THE DRAWINGS

The invention will be closer described below with reference to some embodiments shown in the accompanying drawings.

DETAILED DESCRIPTION OF THE INVENTION

Figure 1:
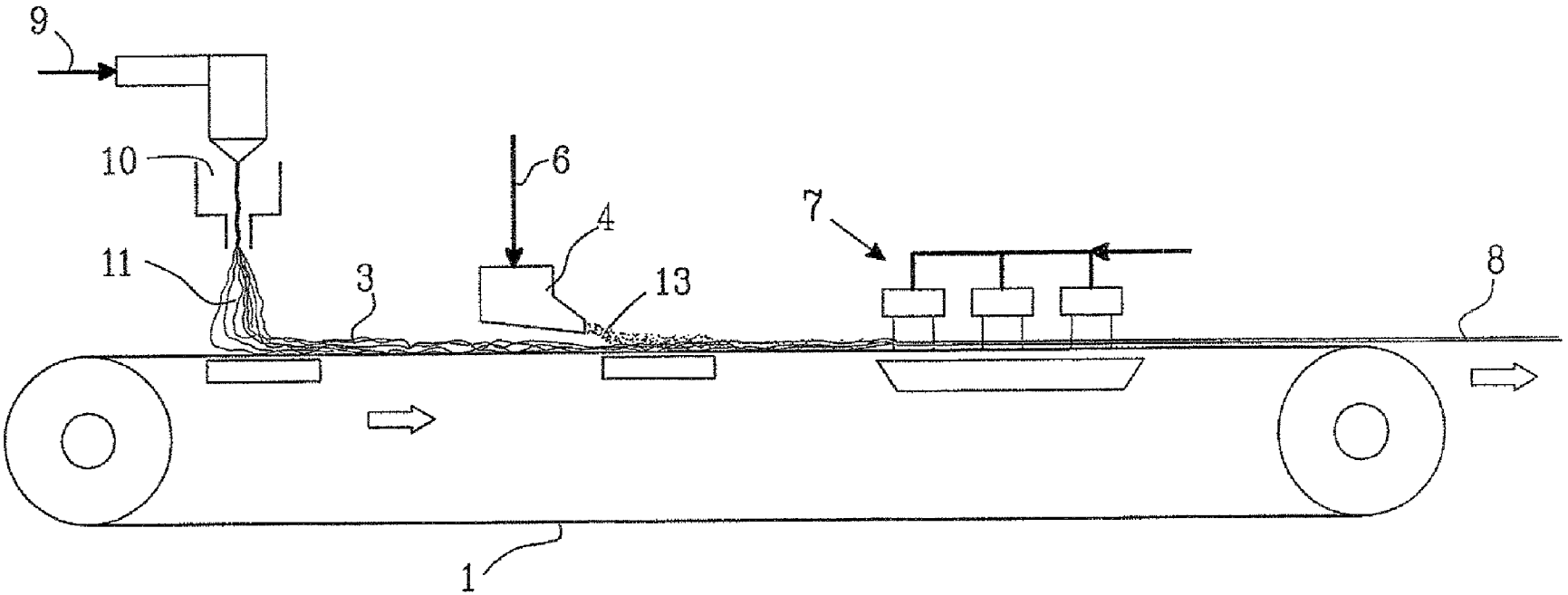
FIG. 1 shows schematically a device for producing a hydroentangled nonwoven material according to the invention.

The improved hydroentangled integrated composite nonwoven material comprises a mixture of continuous filaments and synthetic staple fibres. These different types of fibres are defined as follows.

Filaments

Filaments are fibres that in proportion to their diameter are very long, in principle endless. They can be produced by melting and extruding a thermoplastic polymer through fine nozzles, whereafter the polymer will be cooled, preferably by the action of an air flow blown at and along the polymer streams, and solidified into strands that can be treated by drawing, stretching or crimping, Chemicals for additional functions can be added to the surface.

Filaments can also be produced by chemical reaction of a solution of fibre-forming reactants entering a reagence medium, e.g. by spinning of viscose fibres from a cellulose xanthate solution into sulphuric acid.

Spunbond filaments are produced by extruding molten thermoplastic polymer through fine nozzles in very fine streams and directing converging cooling air flows towards the polymers streams so that they are solidified and then drawn out into continuous filaments with a small diameter. The fibre diameter is normally above 10 μm, usually 10-100 μm. Production of spunbond is e.g. described in U.S. Pat. Nos. 4,813,864 and 5,545,371. Controlling the 'melt flow index' by choice of polymers and temperature profile is an essential part of controlling the extruding and thereby the filament formation.

Spunbond filaments belong to the group called spunlaid filaments, meaning that they are directly, in situ, laid down on a moving surface to form a web, that further on in the process is bonded. Meltblown filaments also belong to this group, but they are not suitable for the invention, as they are too thin and pliable. If they would be used in the nonwoven material of the invention, the result would be a too compact material with too small pores.

Tow is another source of filaments, which normally is a precursor in the production of staple fibres, but also is sold and used as a product of its own. In the same way as with spunlaid fibres, fine polymer streams are drawn out and stretched, but instead of being laid down on a moving surface to form a web, they are kept in a bundle to finalize drawing and stretching. When staple fibres are produced, this bundle of filaments is then treated with spin finish chemicals, normally crimped and then fed into a cutting stage where a wheel with knives will cut the filaments into distinct fibre lengths that are packed into bales to be shipped and used as staple fibres. When tow is produced, the filament bundles are packed, with or without spin finish chemicals, into bales or boxes.

Any thermoplastic polymer, that has enough coherent properties to let itself be drawn out in this way in the molten state, can in principle be used for producing meltblown or spunbond fibres. Examples of useful polymers are polyolefins, such as polyethylene and polypropylene, polyamides, polyesters and polylactides. Copolymers of these polymers may of course also be used, as well as natural polymers with thermoplastic properties.

Staple Fibres

The staple fibres used can be produced from the same substances and by the same processes as the filaments discussed above. Another usable staple fibre is lyocell which is regenerated from alfa-cellulose, and does not absorb water very well; it keeps its integrity and springiness. Ordinary regenerated cellulose fibres, such as viscose are not usable, as they will absorb more water and 'collapse' to be too pliable, easy to entangle, but rendering a hydroentangled nonwoven material that is too compacted and dense, with smaller pores than in the invention.

They can be treated with spin finish and crimped, but this is not necessary for the type of processes preferably used to produce the material described in the present invention. Spin finish and crimp is normally added to ease the handling of the fibres in a dry process, e.g. a card, and/or to give certain properties, e.g. hydrophilicity, to a material consisting only of these fibres, e.g. a nonwoven topsheet for a diaper.

The cuffing of the fibre bundle normally is done to result in a single cut length, which can be altered by varying the distances between the knives of the culling wheel. Depending on the planned use different fibre lengths are used, between 25-50 mm for a thermobond nonwoven. Wetlaid hydroentangled nonwovens normally use 12-18 mm, or down to 9 mm.

For hydroentangled nonwoven materials made by traditional wetlaid technology, the strength of the material and its properties like surface abrasion resistance are increased as a function of the fibre length (for the same thickness and polymer of the fibre).

When continuous filaments are used together with staple fibres, the strength of the material will mostly come from the filaments.

Process

One general example of a method for producing the material according to the present invention is shown in FIG. 1 and comprises the steps of: providing an endless forming fabric 1, where the continuous filaments 11 can be laid down, and excess air be sucked off through the forming fabric, to form the precursor of a web 3;

advancing the forming fabric with the continuous filaments to a wetlaying stage 4, where a slurry comprising staple fibres 6 is wetlaid on and partly into the precursor web of continuous filaments, and excess water is drained off through the forming fabric;

advancing the forming fabric with the filaments and fibres to a hydroentangling stage 7, where the filaments and fibres are mixed intimately together and bonded into a nonwoven web 8 by the action of many thin jets of high-pressure water impinging on the fibres to mix and entangle them with each other, and entangling water is drained off through the forming fabric; advancing the forming fabric to a drying stage (not shown) where the nonwoven web is dried;

and further advancing the nonwoven web to stages for rolling, cutting, packing, etc.

Filament 'Web'

According to the embodiment shown in FIG. 1 the continuous filaments 2 made from extruded molten thermoplastic pellets (in unmolten state 9) are laid down directly on a forming fabric 1 where they are allowed to form an unbonded web structure 3 in which the filaments can move relatively freely from each other. This is achieved preferably by making the distance between the nozzles and the forming fabric 1 relatively large, so that the filaments are allowed to cool down before they land on the forming fabric, at which lower temperature their stickiness is largely reduced. Alternatively, cooling of the filaments before they are laid on the forming fabric is achieved in some other way, e.g. by means of using multiple air sources where air 10 is used to cool the filaments when they have been drawn out or stretched to the preferred degree.

The air used for cooling, drawing and stretching the filaments is sucked through the forming fabric, to let the filaments follow the air flow into the meshes of the forming fabric to be stayed there. A good vacuum might be needed to suck off the air.

The speed of the filaments as they are laid down on the forming fabric is much higher than the speed of the forming fabric, so the filaments will form irregular loops and bends as they are collected on the forming fabric to form a very randomized precursor web.

The basis weight of the formed filament precursor web 3 should be between 15 and 50 g/m$^2$.

Wet-Laying

The staple fibres 6 are slurried in conventional way, and conventional additives, such as retention aids, dispersing agents, etc. can be added, to produce a well mixed slurry of staple fibres and optional additives in water.

This mixture is pumped out through a wet-laying headbox 4 onto the moving forming fabric 1 where it is laid down on the unbonded precursor filament web 3 with its freely moving filaments.

The staple fibres will stay on the forming fabric and the filaments. Some of the fibres will enter between the filaments, but the vast majority of them will stay on top of the filament web.

The excess water is sucked through the web of filaments laid on the forming fabric and down through the forming fabric, by means of suction boxes arranged under the forming fabric.

Entangling

The fibrous web of continuous filaments and staple fibres is hydroentangled while it is still supported by the forming fabric and is intensely mixed and bonded into a composite nonwoven material 8. An instructive description of the hydroentangling process is given in CA patent no. 841 938.

In the hydroentangling stage 7 the different fibre types will be entangled and a composite nonwoven material 8 is obtained in which all fibres and filaments are substantially homogeneously mixed and integrated with each other. The mobile spunlaid filaments are twisted around and entangled with themselves and the other fibres which gives a material with a very high strength.

Preferably, no bonding, by e.g. thermal bonding or hydroentangling, of the precursor filament web 3 should occur before the staple fibres 6 are laid down. The filaments should be completely free to move in respect of each other to enable the staple fibres to mix and twirl into the filament web during entangling. Thermal bonding points between filaments in the filament web at this part of the process would act as blockings to stop the staple fibres to enmesh near these bonding points, as they would keep the filaments immobile in the vicinity of the thermal bonding points. The 'sieve effect' of the web would be enhanced and a more two-sided material would be the result. By no thermal bondings, we mean that there are substantially no points where the filaments have been excerted to heat and pressure, e.g. between heated rollers, to render some of the filaments pressed together such that they will be softened and/or melted together to deformation in points of contact. Some bond points could result from residual tackiness at the moment of laying-down, but these will be without deformation in the points of contact, and would probably be so weak as to break up under the influence of the force from the hydroentangling water jets.

The strength of a hydroentangled material based on only staple fibres will depend heavily on the amount of entangling points for each fibre; thus long staple fibres are preferred. When filaments are used, the strength will be based mostly on the filaments, and reached fairly quickly in the entangling. Thus, most of the entangling energy will be spent on mixing filaments and fibres to reach a good integration. The unbonded open structure of the filaments according to the invention will greatly enhance the ease of this mixing.

Both the filaments and the synthetic fibres 6 are mostly round, with an even structure, of constant diameter, and their properties are not much affected by water. This makes the fibres hard to entangle and force down into a prebonded filament web; they will tend to stay on top. To get enough entangling bonding points to entangle the filaments and fibres securely in a prebonded filament web, high entangling force and energy are needed.

By the inventive use of an unbonded filament web, with no thermal bonding points, in this application it is possible to use the much greater mobility of the unbonded filaments to ease the mixing and entraining of fairly thick and stiff filaments and/or synthetic staple fibres. The actual moving of these thicker and/or stiffer fibres and filaments adds to the energy necessitated to finish the hydroentangling. The fibres and filaments can not be forced close together; thus as a result a hydroentangled nonwoven material with a large amount of large pores is produced.

The entangling stage 7 can include several transverse bars with rows of nozzles from which very fine water jets under very high pressure are directed against the fibrous web to provide an entangling of the fibres. The water jet pressure can then be adapted to have a certain pressure profile with different pressures in the different rows of nozzles.

Care should be taken not to compact the material to be hydroentangled more than absolutely necessary. Choice of the water jet pressures and water jet diameters in the successive rows of nozzles should be done to balance hydroentangling effect against the need of high porosity and high bulk.

Alternatively, the fibrous web can before hydroentangling be transferred to a second entangling fabric. In this case the web can also prior to the transfer be hydroentangled by a first hydroentangling station with one or more bars with rows of nozzles.

Drying Etc

The hydroentangled wet web 8 is then dried, which can be done on conventional web drying equipment, preferably of the types used for tissue drying, such as through-air drying.

No pressing should be done to the hydroentangled wet web 8 before the drying as this tends to compact the pores unnecessarily.

The material is after drying normally wound into mother rolls before converting.

The material is then converted in known ways to suitable formats and packed.

The structure of the material can be changed by further processing such as microcreping, hot calandering, embossing, etc. To the material can also be added different additives such as antistatics, binder chemicals, latexes, etc.

Nonwoven Material

A composite nonwoven material according to the invention can be produced with a total basis weight of 20-120 g/m$^2$, preferably 40-80 g/m$^2$.

The unbonded filaments will improve the mixing-in of the staple fibres, such that the material even when coarser filaments and fibres are used will have enough entangled bonding points to keep the web securely together. The secure bonding will result in very good resistance to linting.

A pore volume with a large percentage of the pores with a size corresponding to an effective radius of 45-150 μm has shown itself to be very effective for distributing and working wax in a polishing situation. From pores under 45 μm it is difficult to get a good release of the wax from the polishing material, and with pores above 150 μm a problem with wax seeping out on the backside arises.

The invention is of course not limited to the embodiments shown in the drawings and described above and in the examples but can be further modified within the scope of the claims.

EXAMPLES

A number of hydroentangled materials according to the invention with different fibre and filament compositions were produced and tested with respect to interesting parameters.

Specific Tests Used:

PVD—Pore Volume Distribution

PVD values for samples according to the invention and for reference samples were measured using a TRI/Autoporosimeter from TRI/Princeton, 601 Prospect Avenue, Princeton, N.J. USA. The function of the equipment is described in detail in Journal of Colloid and Interface Science, 162, 163-170 (1994).

The method is based on measurement of the amounts of test liquid which can be pressed out by air from a wetted porous test sample at certain pressure levels, and the result of the measurement is presented in the form of a curve in a chart where the curve illustrates the overall pore volume for each given pore radius interval.

Each pressure level corresponds to an effective (=seen as circular) pore radius according to calculation with the LaPlace equation:

$$R=2\gamma\cos(\theta)/\Delta P, \text{ where}$$

R=effective pore radius [m]

γ=surface tension at the liquid [J/m2]

θ=receding contact angle [°]

ΔP=pressure exerted [N/m2]

In the measurements, a circular sample with an area of 25.5 cm$^2$ was placed on the membrane (Millipore 0.22 μm cat. No GSWP 09000) in the pressure chamber of the porosimeter and wetted completely. For measuring liquid, n-hexadecane (≧99%, Sigma H-0255) was used. A series of rising air pressure levels was used to get the points of the curve. For each air pressure level, liquid was forced out of the pores with pore radii corresponding to the interval from the last to the present air pressure level.

The liquid forced out was weighed by scales linked to the chamber via a communicating vessel, and after equilibrium was reached a new point on the PVD curve was calculated by the integrated computer.

Wetting Angle (Used for PVD Measurements)

In the LaPlace calculation the wetting angle is needed. This is a measure of how difficult it is for the liquid to wet a test material. A drop of liquid is applied to the test material, and depending on the nature of the test material, the drop may remain lying on top of the material or be absorbed. By measuring the base (d=diameter of drop contact area) and the height (h=height of drop), the contact angle (θ=tangent between plane and drop at contact point) formed between the liquid and the material can be calculated with the aid of the following equation:

$$\tan(\theta/2)=2\,h/d$$

For the nonwoven materials produced according to the invention, and the n-hexadecane used as a measuring liquid, there is complete welling (the liquid is absorbed) and the contact angle θ is 0, resulting in cos(θ)=1 in the LaPlace equation.

Example 1

A 0.4 m wide web of spunlaid filaments was laid down onto a forming fabric at 20 m/min such that the filaments were not bonded to each other. By a 0.4 m wide headbox a fibre dispersion containing staple fibres was laid onto the unbonded web of spunlaid filaments and the excess water was drained and sucked off.

The unbonded spunlaid filaments and wetlaid fibres were then mixed and bonded together by hydroentanglement with three manifolds at a pressure of 5-8 kN/m$^2$. The hydroentanglement was done from the free side and the staple fibres were thus moved into and mixed intensively with the spunlaid filament web. The energy supplied at the hydroentanglement was 600 kWh/ton. Finally the hydroentangled material was dewatered and then dried using a through-air drum drier.

The total basis weight of the spunlaid filament-staple composite was around 50 g/m$^2$.

The composition of the composite material was 50% spunlaid polypropylene filaments and 50% polypropylene staple fibres. The titre of the spunlaid filaments was measured by a scanning electron microscope and found to be 2.7 dtex. The staple PP fibres used were 1.2 dtex with length of 6 mm, delivered by Steen.

Example 2

The set-up of Example 1 was repeated with PET fibres from Kosa. The staple PET fibres used were 1.7 dtex with length of 19 mm. The total basis weight of the spunlaid filament-staple composite was around 60 g/m$^2$.

Example 3

The set-up of Example 1 was repeated with lyocell fibres from Accordis. The staple PET fibres used were 2.4 dtex with length of 12 mm. The total basis weight of the spunlaid filament-staple composite was around 70 g/m$^2$.

Reference 1

The same set-up as in Example 1 was used for the reference materials.

A mixture of 5% polypropylene staple fibres, 1.7 dtex and 6 mm length from Steen together with 70% chemical vigor fluff pulp from Korsnäs was laid on 25% spunlaid polypropylene filaments of 2.1 dtex and hydroentangled.

The energy supplied at the hydroentanglement was 400 kWh/ton. The total basis weight of the spunlaid filament-staple-pulp composite was around 70 g/m$^2$.

Reference 2

50% of splittable bicomponent staple fibres was laid on 50% spunlaid polypropylene filaments of 2.7 dtex and hydroentangled. The splittable fibres were 5 mm long polyamide/polyester of 3.3 dtex before splitting from Kuraray. They nominally would split into fragments of 0.3 dtex.

The energy supplied at the hydroentanglement was 600 kWh/ton. The total basis weight of the spunlaid filament-staple composite was around 60 g/m$^2$.

Comments

Results from the PVD measurements are shown in FIGS. 2 to 5.

Figure 2:
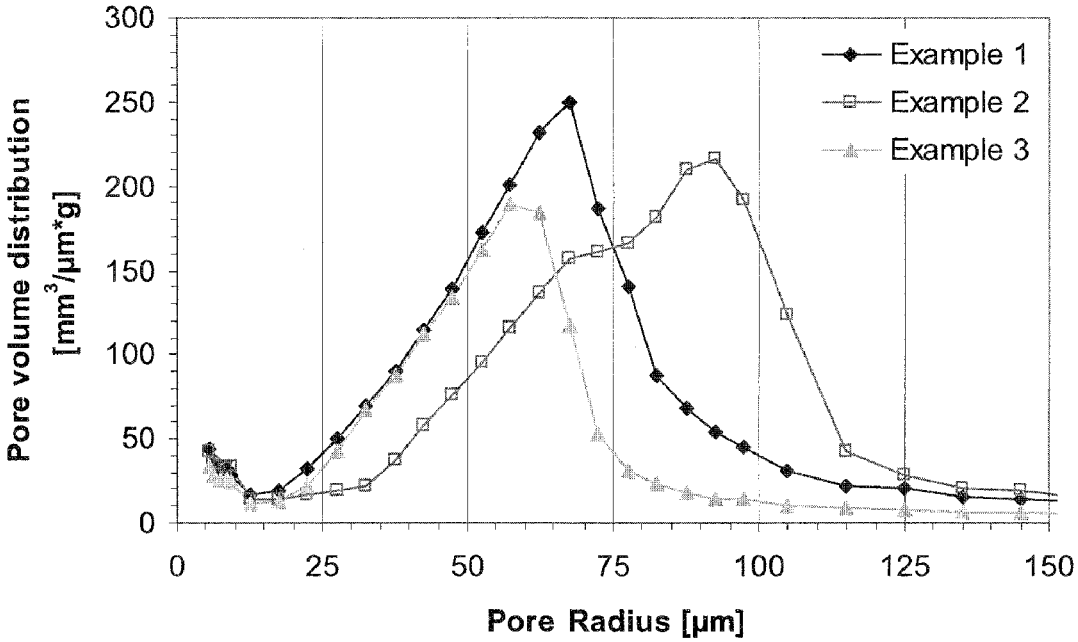
FIG. 2 shows in the form of a diagram the pore volume distribution as a function of pore radius for three examples according to the invention.
Figure 4:
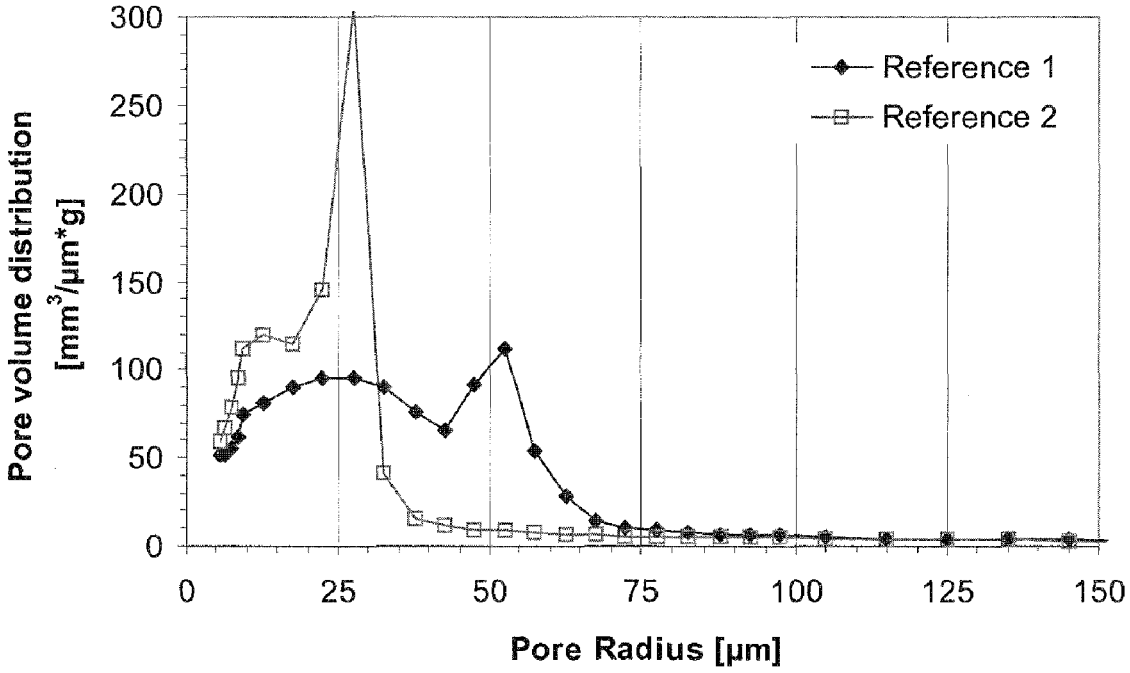
FIG. 4 shows in the form of a diagram the pore volume distribution as a function of pore radius for two reference materials.

FIG. 2 and FIG. 4 show the stepwise pore volume distribution for each air pressure level, corresponding to a certain pore radius, according to the LaPlace equation. It can be seen how the examples in FIG. 2 have a much larger pore radius than the references in FIG. 4.

Figure 3:
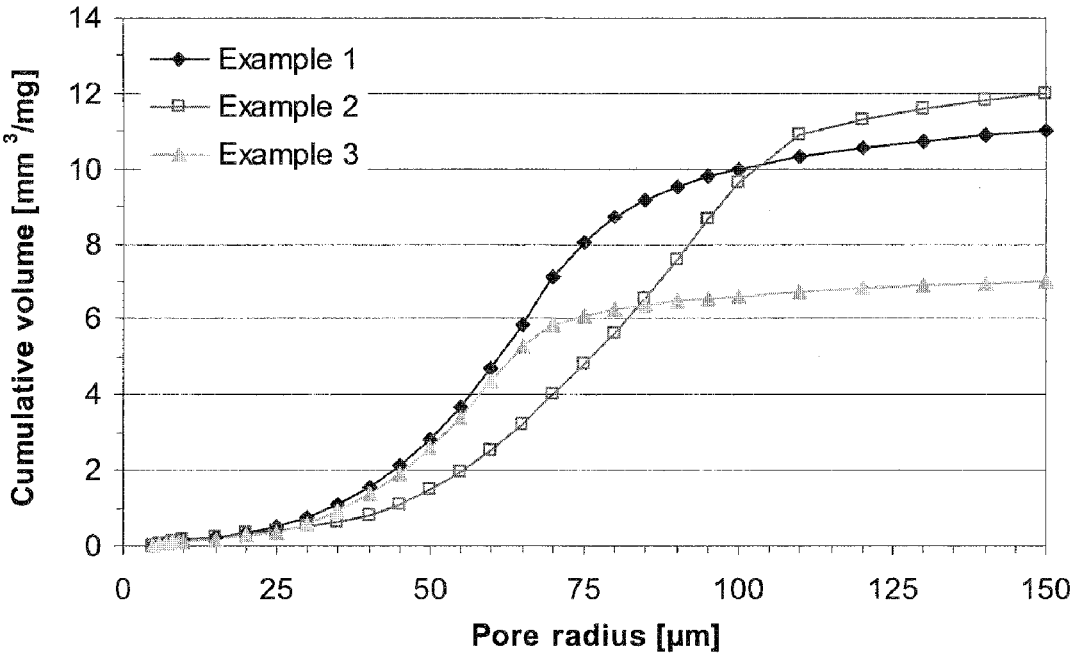
FIG. 3 shows in the form of a diagram the cumulative pore volume as a function of pore radius for three examples according to the invention.
Figure 5:
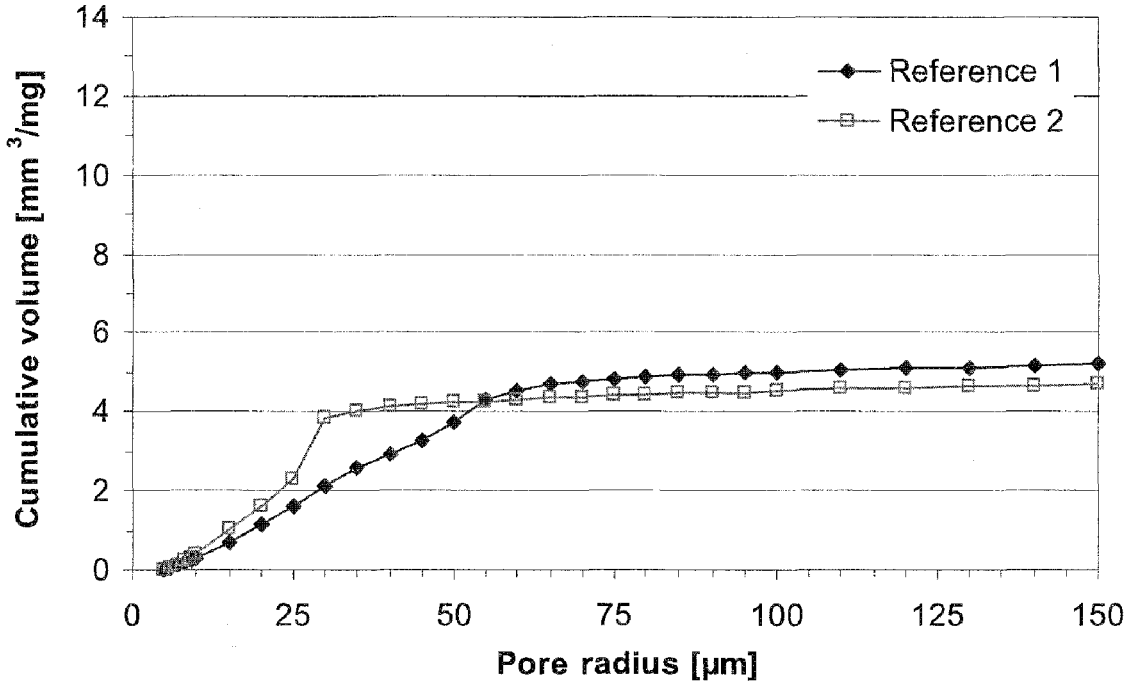
FIG. 5 shows in the form of a diagram the cumulative pore volume as a function of pore radius for two reference materials.

FIG. 3 and FIG. 5 show the cumulative volume in the pores, and are summations from FIG. 2 and FIG. 4. It is seen how most of the pore volume is available in larger pores for the examples in FIG. 3 than in the references in FIG. 5. It is also noticeable that the total cumulative pore volumes are much larger in the examples than in the references.

The mechanical properties of Examples 1 to 3 and Reference 1 and 2 are shown in Table 1. The properties of the examples are quite satisfactory. More entangling energy has been needed for the examples, and for the splittable fibres in Reference 2, than in more ordinary materials, as in Reference 1.

The effect of the larger pores in the inventive materials can be seen in the higher bulk values and in the much lower tensile stiffness values.

TABLE 1

| Properties | Example | | | | |
|---|---|---|---|---|---|
| | Example 1 | Example 2 | Example 3 | Ref. 1 | Ref. 2 |
| Entangling energy (kWh) | 600 | 600 | 600 | 400 | 600 |
| Basis weight (g/m$^2$) | 52 | 60 | 69 | 68 | 61 |
| Thickness 2 kPa (pm) | 616 | 688 | 560 | 421 | 341 |
| Bulk 2 kPa (cm$^3$/g) | 11.9 | 11.5 | 8.1 | 6.2 | 5.6 |
| Tensile stiffness MD (kN/m) | 3.8 | 4.4 | 7.0 | 27.4 | 17.7 |
| Tensile stiffness CD (N/m) | 1.1 | 1.3 | 1.6 | 2.2 | 2.2 |
| Tensile strength dry MD (N/m) | 2045 | 2471 | 2302 | 1694 | 4195 |
| Tensile strength dry CD (N/m) | 1214 | 1247 | 1299 | 933 | 2028 |
| Elongation MD (%) | 113 | 78 | 61 | 49 | 60 |
| Elongation CD (%) | 162 | 137 | 109 | 131 | 120 |
| work to rupture MD (J/m$^2$) | 1661 | 1389 | 1196 | 905 | 1612 |

TABLE 1-continued

| Properties | Example | | | | |
|---|---|---|---|---|---|
| | Example 1 | Example 2 | Example 3 | Ref. 1 | Ref. 2 |
| work to rupture CD ($J/m^2$) | 1151 | 915 | 835 | 817 | 1384 |
| Work to rupture index (J/g) | 26.7 | 18.7 | 14.3 | 12.6 | 24.1 |

In Table 2, it can be seen how for the examples of the invention a large percentage of the pore volume is in the larger pores. Total cumulative pore volume is measured as the volume at 150 μm; some additional small volume may exist in larger pores, but do not function well for a proper release of wax.

TABLE 2

Pore radius (in μm) above which 30%, 50% and 70% of the cumulative pore volume is found, from PVD measurements

| | Example 1 | Example 2 | Example 3 | Reference 1 | Reference 2 |
|---|---|---|---|---|---|
| 30% | 73 | 94 | 63 | 49 | 28 |
| 50% | 64 | 82 | 56 | 36 | 25 |
| 70% | 53 | 68 | 46 | 24 | 19 |

In Table 3 is shown the total pore volume for the example and reference materials, up to a pore size of 150 μm. The available pore volume is greater or much greater in the inventive materials than in the references. The pore volume corresponds to a g/g absorption value.

TABLE 3

Cumulative volume up to pore size 150 μm, from PVD measurements

| | Example 1 | Example 2 | Example 3 | Reference 1 | Reference 2 |
|---|---|---|---|---|---|
| Cumulative volume (m $mm^3$/mg) | 11.04 | 11.98 | 7.00 | 5.20 | 4.70 |

The porosity of the materials is shown in Table 4, where it can be seen that the inventive materials have greater or much greater air permeability than the reference materials.

TABLE 4

Air permeability, measured on Textest FX 3300, air pressure 75 Pa, sample diameter 50 mm.

| | Example 1 | Example 2 | Example 3 | Reference 1 | Reference 2 |
|---|---|---|---|---|---|
| Air permeability ($m^3/m^2$/min) | 93 | 106 | 75 | 24 | 13 |
| Basis weight ($g/m^2$) | 53 | 61 | 68 | 66 | 58 |

The invention claimed is:

1. A hydroentangled integrated composite nonwoven material, comprising a mixture of randomized continuous filaments, and synthetic staple fibres, where there are no thermal bonding points between the continuous filaments such that there is no deformation in the filaments at points of contact between the continuous filament, wherein the nonwoven material exhibits a cumulative pore volume, measured by PVD in n-hexadecane, in the pore radius range 5-150 μm, where at least 70% of the cumulative pore volume is in the pores with a pore radius above 45 μm, and wherein the continuous filaments have a titer of 1.5-4 dtex.

2. The hydroentangled nonwoven material according to claim 1, wherein when the synthetic staple fibres are chosen from the group consisting of polyethylene, polypropylene, polyester, polyamide, and polylactide staple fibres, the nonwoven material exhibits a cumulative pore volume, measured by PVD in n-hexadecane, in the pore radius range 5-150 μm of at least 9 mm3/mg.

3. The hydroentangled nonwoven material according to claim 1, wherein when the synthetic staple fibres are lyocell staple fibres, the nonwoven material exhibits a cumulative pore volume, measured by PVD in n-hexadecane, in the pore radius range 5-150 μm of at least 6 mm3/mg.

4. The hydroentangled nonwoven material according to claim 1, wherein the continuous filaments are spunlaid filaments.

5. The hydroentangled nonwoven material according to claim 1, wherein the continuous filaments are chosen from the group consisting of polypropylene, polyester, and polylactide filaments.

6. The hydroentangled nonwoven material according to claim 1, wherein the synthetic staple fibres are chosen from the group consisting of polyethylene, polypropylene, polyester, polyamide, polylactide, and lyocell staple fibres.

7. The hydroentangled nonwoven material according to claim 1, wherein the synthetic staple fibres are chosen from the group consisting of polyethylene, polypropylene, polyester, polyamide, and polylactide staple fibres and have a titer of 1-4 dtex.

8. The hydroentangled nonwoven material according to claim 1, wherein the synthetic staple fibres are lyocell staple fibres and have a titer of 2-4 dtex.

9. The hydroentangled nonwoven material according to claim 1, wherein more than 95 w-% of the synthetic staple fibres are above 1.5 dtex.

10. The hydroentangled nonwoven material according to claim 1, wherein the mixture of filaments and fibres comprises 20-80% continuous filaments, and 20-80% synthetic staple fibres, all percentages calculated by weight of the total nonwoven material.

11. The hydroentangled nonwoven material according to claim 1, wherein the continuous filaments web part of the composite has a basis weight between 15 and 50 g/m2.

12. The hydroentangled nonwoven material according to claim 1, wherein the nonwoven material does not comprise any natural fibres.

13. The hydroentangled nonwoven material according to claim 1, wherein the mixture of filaments and fibres comprises 30-60% continuous filaments, and 40-70% synthetic staple fibres, all percentages calculated by weight of the total nonwoven material.

* * * * *